US007048295B2

(12) United States Patent
Davies et al.

(10) Patent No.: US 7,048,295 B2
(45) Date of Patent: May 23, 2006

(54) AUTOMATIC, UNIVERSAL BOOT BINDING FOR BOARD SPORTS

(76) Inventors: Ken Davies, 16422 W. Linden St., Caldwell, ID (US) 83607; Steve Koga, 2615 S. Willowbrook St., Caldwell, ID (US) 83607

( * ) Notice: Subject to any disclaimer, the term of this patent is extended or adjusted under 35 U.S.C. 154(b) by 81 days.

(21) Appl. No.: 10/685,880

(22) Filed: Oct. 14, 2003

(65) Prior Publication Data

US 2004/0075246 A1 Apr. 22, 2004

Related U.S. Application Data

(60) Provisional application No. 60/418,081, filed on Oct. 11, 2002.

(51) Int. Cl.
*A63C 9/02* (2006.01)

(52) U.S. Cl. ..... 280/623; 280/634

(58) Field of Classification Search ..... 280/613, 280/617, 618, 623, 624, 633, 634, 842, 11.36
See application file for complete search history.

(56) References Cited

U.S. PATENT DOCUMENTS

| | | | | | |
|---|---|---|---|---|---|
| 4,236,725 | A | * | 12/1980 | Bataille | 280/611 |
| 4,979,760 | A | | 12/1990 | Derrah | 280/607 |
| 5,556,123 | A | | 9/1996 | Fournier | 280/607 |
| 5,609,347 | A | | 3/1997 | Dressel | 280/14.2 |
| 5,660,410 | A | | 8/1997 | Alden | 280/627 |
| 5,692,765 | A | | 12/1997 | Laughlin | 280/619 |
| 5,758,895 | A | * | 6/1998 | Bumgarner | 280/607 |
| 5,857,700 | A | | 1/1999 | Ross | 280/623 |
| 5,918,897 | A | | 7/1999 | Hansen et al. | 280/611 |
| 5,997,027 | A | * | 12/1999 | Jungkind | 280/617 |
| 6,003,893 | A | | 12/1999 | Hansen | 280/624 |
| 6,007,077 | A | | 12/1999 | Moe | 280/14.2 |
| 6,065,770 | A | | 5/2000 | Hansen et al. | 280/617 |
| 6,116,634 | A | * | 9/2000 | Mometti | 280/613 |
| 6,123,354 | A | | 9/2000 | Laughlin et al. | 280/617 |
| 6,189,913 | B1 | | 2/2001 | Morrow et al. | 280/613 |
| 6,203,052 | B1 | | 3/2001 | Dodge | 280/624 |
| 6,231,066 | B1 | | 5/2001 | Okajima | 280/623 |
| 6,247,728 | B1 | | 6/2001 | Verville | 280/811 |
| 6,270,109 | B1 | | 8/2001 | Turner et al. | 280/613 |
| 6,273,450 | B1 | | 8/2001 | Challande et al. | 280/624 |
| 6,276,709 | B1 | | 8/2001 | Chen et al. | 280/650 |
| 6,293,577 | B1 | | 9/2001 | Shields | 280/617 |

(Continued)

FOREIGN PATENT DOCUMENTS

FR 2689776 * 10/1993

(Continued)

*Primary Examiner*—Frank Vanaman
(74) *Attorney, Agent, or Firm*—Pedersen & Co., PLLC; Ken J. Pedersen; Barbara S. Pedersen

(57) ABSTRACT

A boot-binding for board sports such as snowboarding is provided that is both automatically closing and compatible with any style of boot or shoe. A molded plastic shell which is fixedly attached to the board's upper surface provides a substantially boot-shaped receiving space and an automatic closing gate clamps down tightly across the boot's upper surface to bind the foot tightly. In operation, the rider simply steps into the binding thereby actuating a release mechanism which allows the gate to swing closed. Gate receptors mounted to the exterior of the plastic shell opposite the hinge accept and latch the gate firmly across boot's upper surface. Several cushioning elements, some of which may be inflatable, may be included and manual adjustments may be made without special tools to adjust the fit and feel of the binding.

24 Claims, 6 Drawing Sheets

U.S. PATENT DOCUMENTS

| | | | | |
|---|---|---|---|---|
| 6,588,773 | B1 * | 7/2003 | Van Riet et al. | 280/14.22 |
| 2001/0009320 | A1 | 7/2001 | Couderc et al. | 280/14.24 |
| 2002/0163161 | A1 * | 11/2002 | Mandon | 280/618 |
| 2003/0038456 | A1 * | 2/2003 | Carrasca | 280/624 |
| 2003/0201624 | A1 * | 10/2003 | Pascal | 280/623 |
| 2004/0239078 | A1 * | 12/2004 | Messmer | 280/623 |

FOREIGN PATENT DOCUMENTS

| | | | |
|---|---|---|---|
| FR | 2758469 | * | 7/1998 |
| FR | 2819196 | * | 7/2002 |

* cited by examiner

AUTOMATIC, UNIVERSAL BOOT BINDING FOR BOARD SPORTS

DESCRIPTION

This application claims priority of Provisional Application Ser. No. 60/418,081, filed Oct. 11, 2002, and entitled "Automatic, Universal Boot Binding for Board Sports", which is hereby incorporated by reference.

BACKGROUND OF THE INVENTION

1. Field of the Invention

This invention relates generally to board sports such as snowboarding and boot bindings for use in such activities. More specifically, this invention relates to an automatically closing and latching binding for use in board sports which is compatible with any style boot or shoe.

2. Related Art

Ross (U.S. Pat. No. 5,857,700) discloses a snowboard binding for a generic soft boot. The binding has a pair of straps attached at their proximal ends to a baseplate and at their distal ends to a connecting rod. A rotating latch is mounted to the connecting rod and engages a bar which is attached to the side of the baseplate opposite the proximal end of the straps.

Hansen, et al. (U.S. Pat. No. 6,065,770) describes a snowboard binding mechanism in which the binding instep is coupled to the binding sidewalls using flexible, tensile elements. The tensile elements are fixed at one end to the binding instep and fixed at the other end to a vertically-slid heel bar. The rider inserts the boot toe in the binding instep shell and presses the heel downward on the heel bar. As this pressure is applied, the tensile elements move downward in similar fashion, thus drawing the instep down upon the boot's upper surface. As the boot is positioned on the board surface, a latching mechanism fastens the heel bar securely. Removal is not assisted by any spring mechanism and the rider is required to apply upward pressure on the binding instep while releasing the latching mechanism.

Morrow, et al. (U.S. Pat. No. 6,189,913) describes a snowboard binding mechanism that utilizes a fixture imbedded in the boot sole that couples with a latching mechanism on the board surface. This pairing enables convenient step-in performance, but requires specialized footwear.

Couderc, et al. (U.S. Pat. App. Pub. No. 2001/0009320) discloses a snowboard binding with a single linkage to connect two lateral edges. The linkage comprises two or more points for fastening to a first of the edges, and a single point for fastening to the second of the edges.

It is the object of the present invention to simplify the binding-entry process for snowboarders of every skill level without compromising comfort or functionality and without requiring riders to purchase additional or specialized equipment.

SUMMARY OF THE INVENTION

In accordance with the objectives of the present invention, the disclosed automatic closing and latching binding offers a simple and effective means of securing any style boot to a conventional snowboard or other flat riding-board. The preferred embodiment comprises a lightweight, molded shell for receiving the boot of the rider, an automatic or semi-automatic closing and latching mechanism and a system for adjusting the fit of the binding to the boot.

The boot-receiving enclosure portion of the binding is shaped to substantially resemble a snow boot without conforming to any particular boot style. This exterior shell is fixedly attached to the board's top surface and forms the base of the binding. Metal, plastic, or another sufficiently rigid material may be used for the shell so long as the material properties remain stable over a wide range of temperatures.

The automatic latching mechanism comprises an automatic closing gate and a foot activated release mechanism. The food-activated mechanism is adapted so that any conventional boot will trip the mechanism as the boot touches the mechanism, and no mating or other engagement with the mechanism is required. When the rider steps into the binding, the release mechanism is actuated and the gate swings closed across the boot-receiving space and the upper surface of the boot. At the end of the swing, one or more cooperating tab ends situated at the end of the gate opposite the rotating hinge automatically seat within cooperating receiver(s) which are mounted to the shell's exterior.

Adapting the fit and feel of the binding to various boot styles, sizes and user preferences is easily accomplished via, for example, ratcheting adjustments and/or other tuning steps. Preferably, adjustments include mechanisms that are easily done with a single tool, such as a Phillips screwdriver, or that are tool-free. This way, the user can quickly and conveniently adjust the bindings to any boot anywhere without the need for any tool(s).

DETAILED DESCRIPTION OF THE INVENTION

Referring to the figures, there is shown one, but not the only, embodiment of the invented universal boot binding. The preferred embodiment of the present invention includes a base plate, vertical support, and automatic closing gate.

Other optional features include a support tab, a foot-activated actuator for the closing gate, and a forward lean system. Preferably, essentially all features of the binding are adjustable so that one binding is fully functional over a wide of range of boot designs and sizes. The binding may be constructed from any rigid or semi-rigid material so that substantially all of the force of the user it transferred to the board via the binding. Preferably, it is constructed from aluminum and/or rigid plastic.

Figure 1:
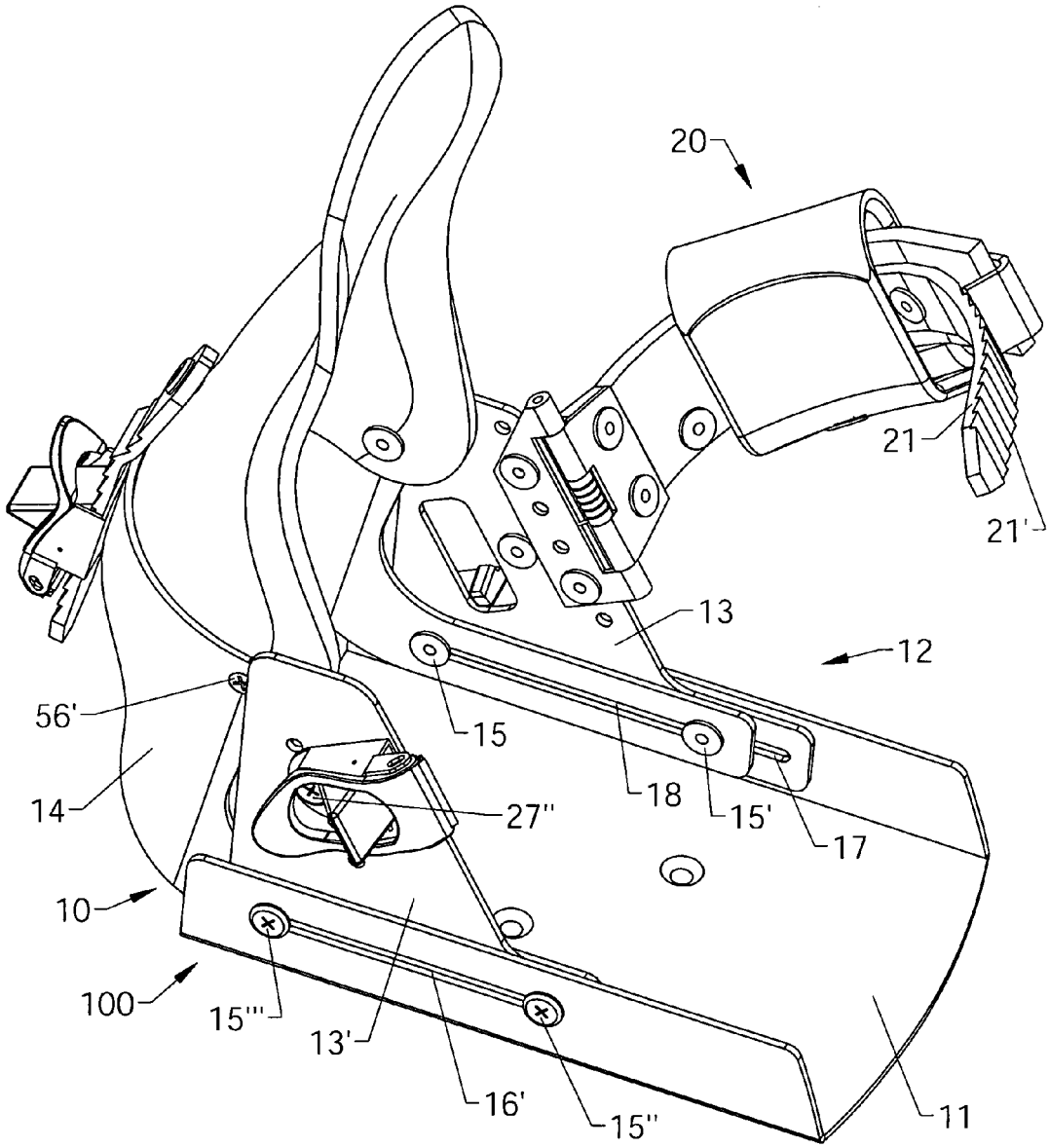
FIG. 1 is a right top perspective view of the preferred embodiment of the present invention with the gate mechanism open.
Figure 2:
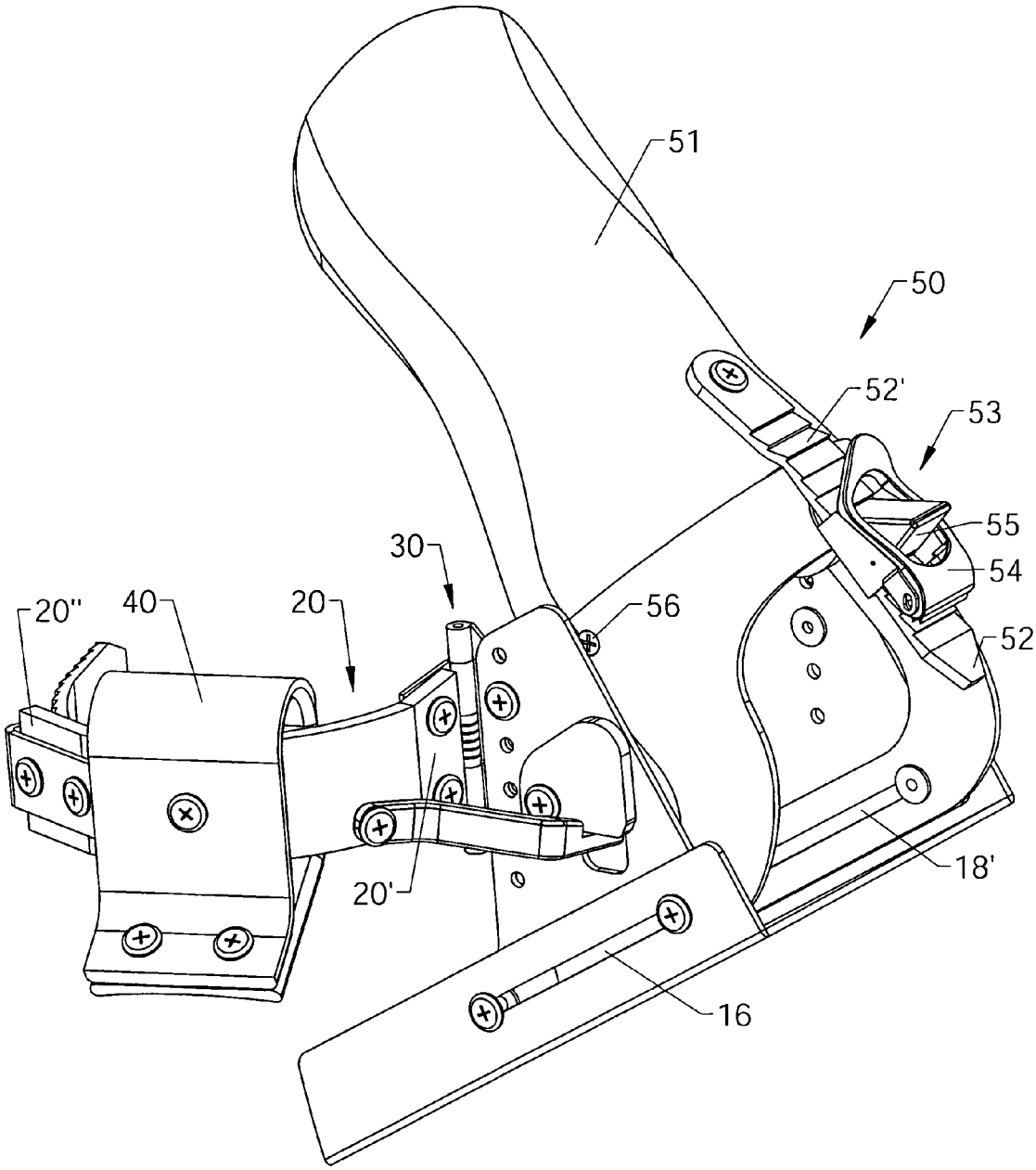
FIG. 2 is a left bottom perspective view of the embodiment of the embodiment of FIG. 1 with the gate mechanism open.
Figure 5:
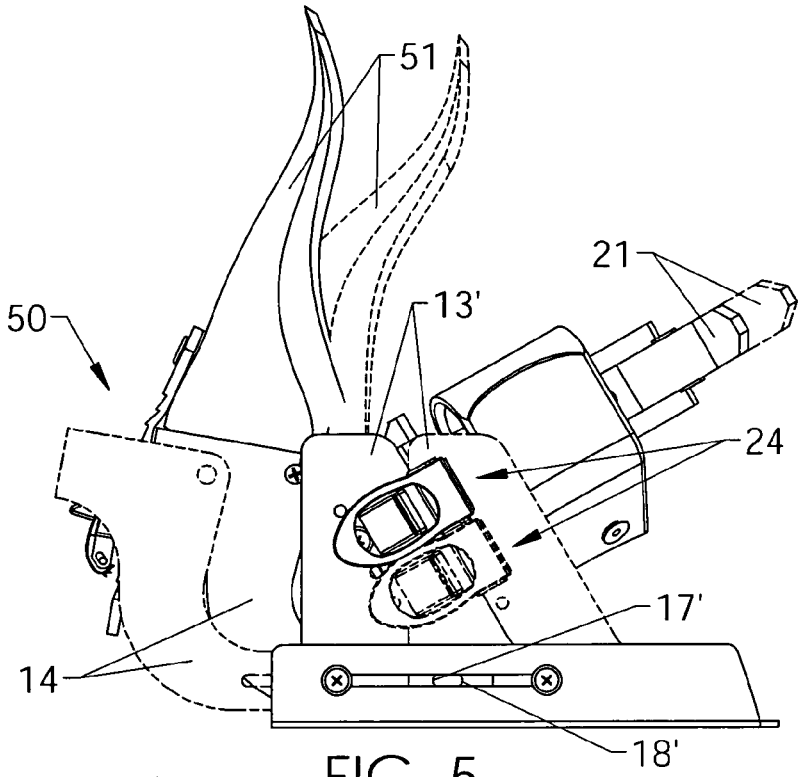
FIG. 5 is a right side view of the embodiment of FIGS. 1–4 with the gate mechanism open and with the adjustability of embodiments of the ankle support, calf support, latch, and gate tab illustrated in dashed lines.

Referring to FIGS. 1 and 2, the preferred embodiment of universal boot binding 100 is shown with gate 20 in the open position. Outer shell 10 comprises base plate 11 and vertical support 12. Base plate 11 is securely attached to the board, by screws or other conventional fasteners. Vertical support 12 includes side supports 13 and 13' and ankle support 14, and functions to stabilize the boot in binding 100 on the rear and two sides of the boot. Preferably, supports 13, 13', and 14 do not move relative to each other. Side supports 13 and 13' and ankle support 14 surround the boot on three sides and are designed to be fixedly attached to base plate 11 at all times, except when adjusting the position of vertical support 12 on base plate 11. As shown in FIGS. 1 and 5, four female-male screw attachments 15, 15', 15", and 15'" pass through slots 16 and 16' in base plate 11; slots 17 and 17' in side supports 13 and 13'; and slots 18 and 18' in ankle support 14. Vertical support 12 may be moved longitudinally—i.e., from toe to heel—as appropriate for the user's boot. In order to accommodate varying boot widths, binding 100 may be manufactured in various sizes. Alternatively, binding 100 could have an adjustable width.

Returning to FIGS. 1 and 2, the boot, when in use, is further held in place by gate 20, which covers or encloses at least a portion of the front of the boot by extending over the instep or top of the boot. The gate is releasably held in an open position when no boot is in binding 100. Gate 20 is pivotally attached at its base end 20' to side member 13 and is preferably held open by a catch system comprising catch arm 33 and catch plate 32, as shown in FIG. 4. Gate 20 swings in a radius over the instep of the boot. Catch arm 33, which is attached to gate 20 at its base 33', extends under and catches on catch plate 32 via notch 33'" near its free end or tip 33". In the preferred embodiment, the tip 33" of catch arm 33 extends into the interior of the binding through opening 35 such that it will be contacted by the boot heel when the boot is being placed in the binding. This contact will cause catch arm 33 to be moved downward and away from catch plate 32. Gate 20 is preferably spring-biased to the closed position, shown in FIGS. 3 and 4. Alternatively, biasing means other than a coiled spring, such as other springs or flexing members. Preferably, disengaging catch arm 33 from catch plate 32 allows optional spring 31 to pivot gate 20 to the closed position. Thus, catch arm 33, catch plate 32, and spring 31 comprise a foot-activated actuator 30 for closing gate 20. In an alternative embodiment, spring 31 may be omitted to eliminate the danger that a user's hand could be accidentally caught by a closing gate e.g., in an embodiment designed for children. Preferably, there is no connection and net no contact between the boot and catch system once actuator 30 is triggered. Catch arm 33 is preferably made from a resilient, rather than brittle, material so that it will snap into and out of position with catch plate 32 many times during the binding's life.

Figure 3:
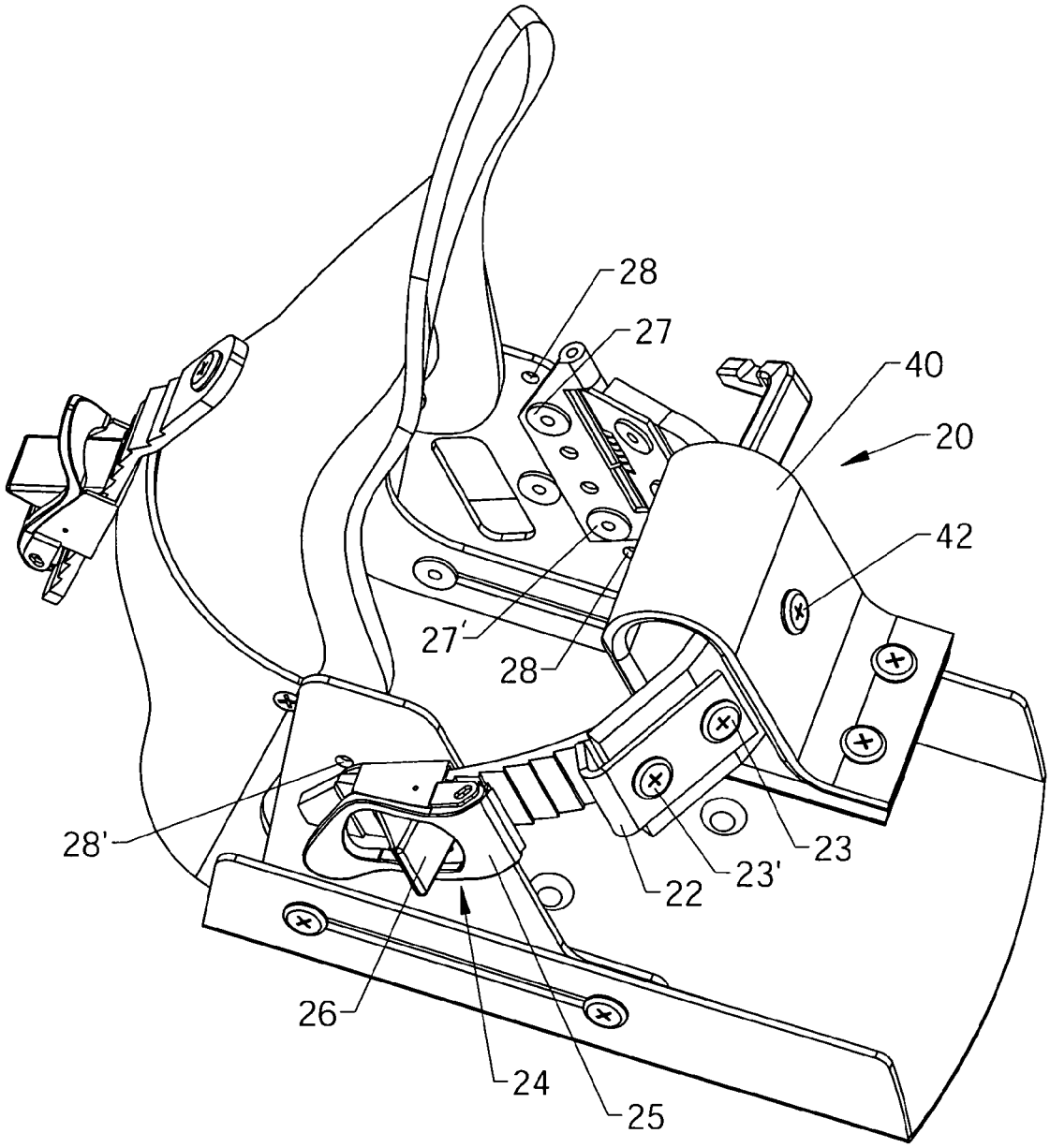
FIG. 3 is a right top perspective view of the embodiment of the embodiment of FIGS. 1 and 2 with the gate mechanism closed.
Figure 4:
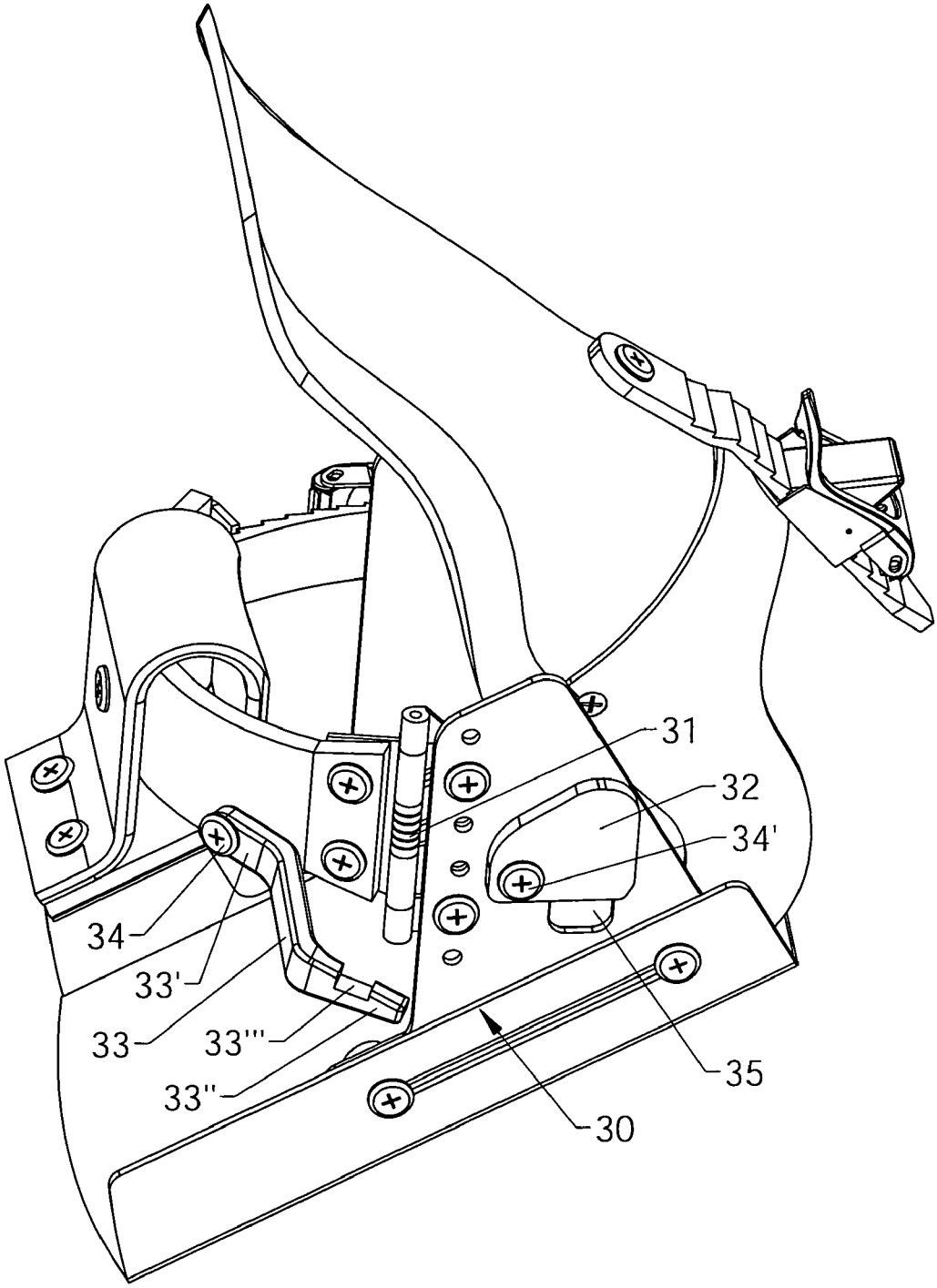
FIG. 4 is a front left perspective view of the embodiment of the embodiment of FIGS. 1, 2, and 3 with the gate mechanism closed.

Referring to FIGS. 3 and 4, the preferred embodiment of universal boot binding 100 is shown with gate 20 in the closed position. Distal end of gate 20 preferably includes a ridged gate tab 21 that cooperatively fits into gate latch 24. When actuator 30 is triggered by the user's foot, spring 31 causes gate 20 to swing from the open to the closed position with gate tab 21 entering gate latch 24. However, this will typically not close gate 20 with sufficient tightness for most users. For that reason, gate latch 24 preferably includes gate ratchet 25 that works on teeth 21' to tighten gate 20, as needed. Gate latch 24 also includes release 26 so that gate latch 24 may be opened and gate tab 21 removed.

As shown in FIG. 2, support tab 40 is attached to gate 20 so that it is above the approximate center of the binding or boot when gate 20 is closed. Support tab 40 contacts the upper toe portion of the boot. This increases the pressure on the boot by pressing rearward and slightly downward, pushing the heel back into the binding and making the fit of the boot in the binding more comfortable. In an alternative embodiment, support tab 40 may also be vertically adjustable to increase the downward pressure on the boot. Support tab 40 may be made from a rigid or semi-rigid material, or it may be an inflatable piece.

Snowboarding requires the rider to bend his knees rather than standing straight upright above the board. To aid in maintaining this position, the preferred embodiment includes forward lean system 50 that prevents the rider from standing perfectly upright while still allowing the rider to bend his knees and ankles. The preferred forward lean system comprises calf support 51, ridged tab 52, and latch 53, which includes ratchet 54 and release 55. Calf support 51 is pivotally attached to outer shell 10, on ankle support 14, via female-male screw attachments 56 and 56' such that its pivot direction matches that of the user's leg bending at the ankle. Latch 53 cooperatively receives and holds tab 52, and tab 52 is positioned with its teeth 52' pointing downwards. Ratchet 54 acts to move tab 52 out of latch 53 such that calf support 51 pivots towards the user's legs—i.e., moves forward. Release 55 allows tab 52 to be moved out of latch 53 with little resistance (that is, up and/or forward), but prevents movement in the opposite (downward/rearward) direction until release 55 is activated to release the tab. Preferably, the user may manually pivot calf support 51 forward without using ratchet 54, but may desire to use ratchet 54 for small adjustments or when the user's boots are already engaged in binding 100. Thus, the rearward force applied to calf support 51 when the user attempts to straighten his legs is countered by the latch system, and, generally, no forward force is applied to calf support 51 during use. Therefore, the position of calf support 51 is preferably fixed during use; the user may increase the bend of his knees and ankles, but cannot straighten his legs.

In the preferred embodiment, all features affecting the fit and feel of the binding on a boot are adjustable so that the binding can be compatible with the largest number of boots possible, as variously illustrated in FIGS. 5–8. It is not necessary for any part of binding 100 to mate—i.e., mechanically join or connect—with any portion of a boot. Preferably, the boot is held tightly to eliminate, as much as reasonably possible, any movement of the boot within the binding during use, but an exact fit is not required.

Base plate 11 has an upward extension on the left and right of binding 100 with slots 16 and 16'. Side supports 13 and 13' have slots 17 and 17' near their base. Heel support 14 has a longitudinal extension on the left and right sides of binding 100 with slots 18 and 18'. As illustrated in FIG. 1, these slots are sized and positioned so that female-male screw attachment 15 and 15' may pass through and bind slots 16, 17, and 18 simultaneously. Similarly, female-male screw attachment 15" and 15'" may pass through and bind slots 16', 17', and 18' simultaneously. Preferably, side supports 13 and 13' and ankle support 14 are separate pieces, all adjustably held in place by male-female screw attachments 15, 15', 15", and 15'". As illustrated with dotted lines in FIGS. 5 and 7, this allows side supports 13 and 13' and ankle member 14 to be separately moved, rather than as a whole unit, in the longitudinal plane so that the boots are properly fitted into the binding and positioned above the board.

Figure 6:
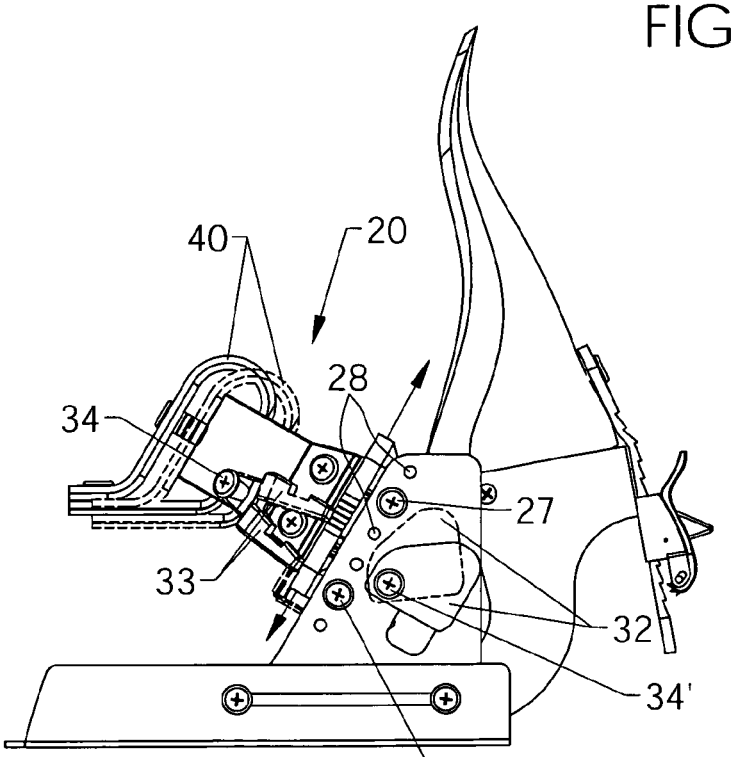
FIG. 6 is a left side view of the embodiment of FIGS. 1–5 with the gate mechanism closed and with the adjustability of embodiments of the support tab, catch arm, and catch plate illustrated in dashed lines and gate illustrated with arrows.
Figure 7:
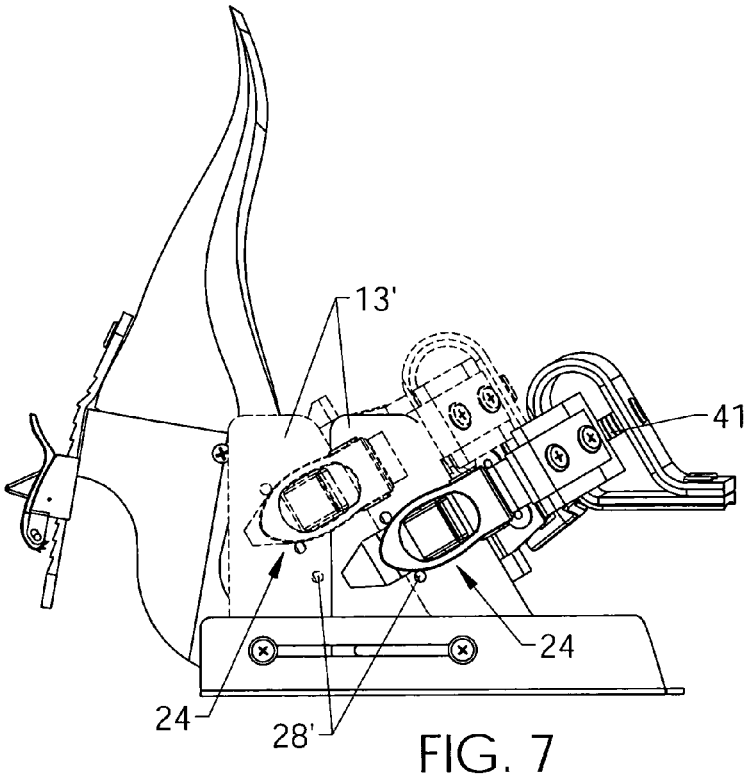
FIG. 7 is a right side view of the embodiment of FIGS. 1–6 with the gate mechanism closed and with the adjustability of embodiments of the side members and latch illustrated in dashed lines.
Figure 8:
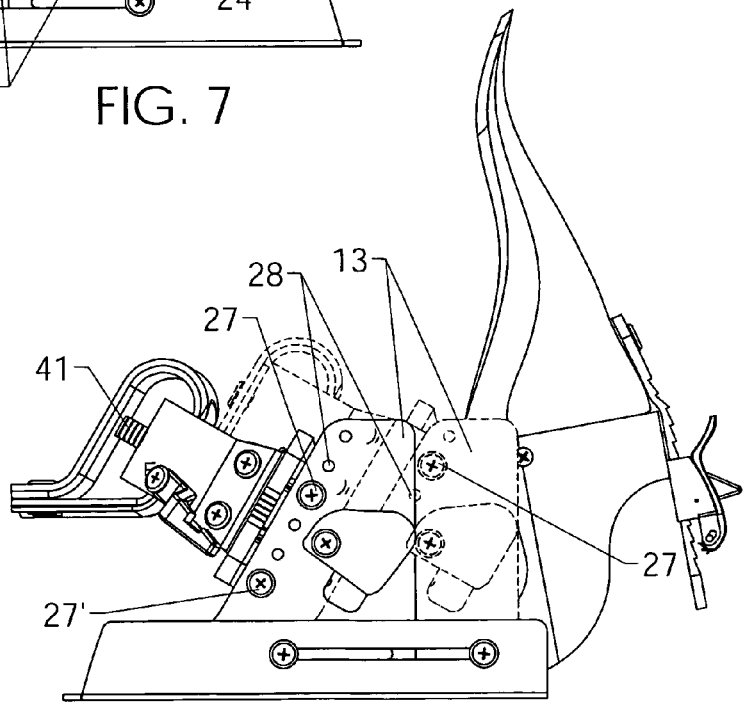
FIG. 8 is a left side view of the embodiment of FIGS. 1–7 with the gate mechanism closed and with the adjustability of embodiments of the side members and gate illustrated in dashed lines.

Gate 20 is detachably attached to outer shell 10 with two male-female screw attachments 27 and 27' via screw holes 28, as best illustrated in FIG. 6. In the preferred embodiment, six screw holes 28 are provided allowing gate 20 to be attached to outer shell 10 in three discreet positions. Latch 24 is also attached via male-female screw attachment 27" via screw hole 28', and multiple screw holes 28' are provided to match the possible positions of gate 20 so that gate 20 will close and latch automatically at any position, as illustrated in FIGS. 5 and 7. This allows gate 20 and latch 24 to be adjusted generally vertically, but with some longitudinal adjustment also occurring. The direction of adjustment is designed to correspond generally to the face of most boots. Alternatively, gate 20 and latch 24 could be continuously adjustable, rather than incrementally, by the use of continuous slots or channels and cooperating tightness.

To insure that tab 21 will always enter latch 24 automatically, L-shaped deflection arm 22 is adjustably attached to gate 20 via two male-female screw attachments 23 and 23'. As shown in FIG. 3, the top end of deflection bar 22 is tightly attached via first male-female screw attachment 23 and second male-female screw attachment 23' passes through the approximate center of the same part deflection bar 22. By adjusting second male-female screw attachment 23', the tip of deflection bar 22 contacts tab 21 and radially adjusts its position in the swing radius of gate 20, as illustrated in FIG. 5 with deflection bar 22 shown in two possible positions.

Returning to FIG. 6, catch arm 33 is pivotally attached to gate via male-female screw attachment 34. Catch plate 32 is also pivotally attached to gate via male-female screw attachment 34'. This allows catch arm 33 and catch plate 32 to be adjusted to optimize their cooperative connection, which functions to releasably hold gate 20 in the open position. This feature is particularly important in alternative embodiments where gate 20 and latch 24 are continuously adjustable.

As illustrated in FIG. 6, support tab 40 is attached to gate 20 via male-female screw attachment 42 with spring 41 placed around male-female screw attachment 42 between support tab 42 and gate 20. Spring 41 biases support tab 40 away from gate 20 and tightening male-female screw attachment 42 forces support tab 40 toward gate 20.

Any connection means may be used, but connectors that will allow for adjusting the position of the various parts is highly preferred. The preferred connector for all parts of the preferred embodiment comprises a screw and receiver where the receiver is flat. The screw is preferably positioned outside the binding and the flat receiver is positioned inside binding with the screw long enough to engage the receiver but short enough not to gouge the boot. (See female-male screw attachments 15, 15', 15", and 15'" as examples.) Alternatively, tool-free connectors may be used. For example, wing nuts or thumb screws could be used where it is necessary to remove the connector completely, such as with gate 20. These type of connectors could also be used where it is only necessary to loosen a connector to allow a part to pivot, such as catch plate 32. Connectors such as cammed latches could be used for fasteners that are tightened against walls of a slot or channel, such as with the connection between vertical support 12 and base plate 11.

Although this invention has been described above with reference to particular means, materials, and embodiments, it is to be understood that the invention is not limited to these disclosed particulars, but extends instead to all equivalents within the scope of the following claims.

We claim:

1. A universal boot binding for use with a user's boot and a recreational riding board, the boot binding comprising:

an outer shell partially surrounding an interior space for receiving a user's boot, the outer shell comprising:

a base portion that is adapted to be fixed to an upper surface of a riding board, and a generally vertical stabilizing portion mounted to said base portion at or near the rear of the base portion for stabilizing the boot heel area;

a closing gate for securing the boot within the binding, the closing gate connected to said outer shell and being pivotal between an open position, away from the interior space to open the interior space to allow insertion of said boot, and a closed position that holds the boot in the interior space; and a catch system adapted to hold said closing gate in the open position until the boot impacts a portion of the catch system while being inserted into the interior space, wherein said portion of the catch system is not adapted to remain in contact with the boot after the boot impacts said portion of the catch system to close the closing gate.

2. A boot binding system as in claim 1, further comprising a latch system for securing the closing gate in the closed position, wherein, when said closing gate swings to the closed position, a distal end of the closing gate enters the latch system and engages with the latch system to hold the closing gate in the closed position.

3. A boot binding system as in claim 2, wherein the closing gate further comprises a biasing mechanism that urges the closing gate into the closed position.

4. A boot binding according to claim 1, further comprising a lean support member pivotally connected to said base portion for extending upwards along a calf of the user.

5. A boot binding according to claim 1, wherein said stabilizing portion is adjustably attached to said base portion such that said stabilizing portion may be adjusted longitudinally toward and away from said closing gate.

6. A boot binding according to claim 1, wherein said catch system comprises a portion that is adjustably connected to said closing gate.

7. A boot binding according to claim 6, wherein said catch system comprises a portion adjustably connected to said outer shell.

8. A boot binding according to claim 6, wherein said catch system comprises a catch arm and a catch plate, wherein the catch arm is said portion of the catch system that is impacted by the boot, and wherein said catch plate is attached to said outer shell and is a portion of the binding upon which the catch arm catches to hold the closing gate in the open position.

9. A boot binding according to claim 8, wherein said catch plate is adjustable in position on the outer shell.

10. A boot binding according to claim 8, wherein said catch arm is adjustable in position on the closing gate.

11. A universal boot binding for use with a recreational riding board comprising:

an outer shell at partially surrounding an interior space for receiving a boot;

a closing gate for securing the boot within the binding, the closing gate pivotally connected to said outer shell and being pivotal between an open position, away from the interior space to open the interior space to allow insertion of said boot, and a closed position over the instep of a user's boot that retains a user's boot in the outer shell;

a boot-activated actuator adapted to close the closing gate, wherein said actuator is not adapted to remain in contact with the user's boot after the boot impacts the actuator to close the closing gate; and at least one adjustment system adapted to change the size and shape of the interior space.

12. A boot binding according to claim 11, further comprising a latching mechanism on the outer shell, wherein said closing gate is automatically secured in the closed position by the latching mechanism when the closing gate swings to the closed position.

13. A boot binding according to claim 12, wherein said latching mechanism is adjustable to tighten and to loosen the fit of the closing gate across the interior space.

14. A boot binding according to claim 12, wherein said latching mechanism includes a ratcheting mechanism that tightens the fit of said closing gate.

15. A boot binding according to claim 12, wherein said closing gate includes a tab and said latching mechanism includes a receiving slot that cooperates with said tab.

16. A boot binding according to claim 12, wherein the closing gate curves generally on a radius from a first side of the outer shell to a second side of the outer shell and said closing gate comprises a distal end adapted to cooperate with the latching mechanism, and the distal end is radially adjustable.

17. A boot binding according to claim 12, wherein said latching mechanism is adjustable en in a generally vertical direction on the outer shell.

18. A boot binding according to claim 12, wherein said closing gate is adjustable in a generally vertical direction on the outer shell.

19. A boot binding according to claim 16, wherein said closing gate further comprises a support member that extends generally radially into the interior space for contacting an upper surface of the boot in the interior space.

20. A boot binding according to claim 19, wherein said support member applies downward and rearward pressure to said upper surface of boot.

21. A boot binding according to claim 19, wherein position of said support member is radially adjustable on the closing gate.

22. A boot binding according to claim 11, further comprising a forward lean system comprising a vertical leg support pivotally connected to the outer shell and adapted to pivot forward to a forward position and be locked in that forward position to urge a user's legs to lean forward.

23. A boot binding according to claim 22, wherein said forward lean system further comprises a locking system comprising:

a tab; and a receiving slot that cooperates with said tab;

wherein said leg support is pivotally connected to said outer shell and is lockable by said locking system in an angle of connection, wherein said angle of connection is controlled by adjustable cooperation of said tab and said receiving slot.

24. A boot binding according to claim 23, wherein said tab and said receiving slot releasably attach to one another via a ratcheting mechanism that adjust the position of said tab to said slot.

* * * * *